US010329887B2

(12) United States Patent
Livescu et al.

(10) Patent No.: US 10,329,887 B2
(45) Date of Patent: Jun. 25, 2019

(54) DUAL-WALLED COILED TUBING WITH DOWNHOLE FLOW ACTUATED PUMP

(71) Applicant: Baker Hughes Incorporated, Houston, TX (US)

(72) Inventors: Silviu Livescu, Calgary (CA); Timothy T. Ramsey, Spring, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 155 days.

(21) Appl. No.: 15/488,923

(22) Filed: Apr. 17, 2017

(65) Prior Publication Data

US 2017/0218738 A1 Aug. 3, 2017

Related U.S. Application Data

(63) Continuation-in-part of application No. 14/635,569, filed on Mar. 2, 2015, now abandoned.

(51) Int. Cl.
*E21B 43/12* (2006.01)
*E21B 17/00* (2006.01)

(52) U.S. Cl.
CPC ..... *E21B 43/129* (2013.01); *E21B 17/003* (2013.01); *E21B 43/128* (2013.01)

(58) Field of Classification Search
CPC ..... E21B 17/203; E21B 43/129
See application file for complete search history.

(56) References Cited

U.S. PATENT DOCUMENTS

| | | | | |
|---|---|---|---|---|
| 5,269,377 | A | 12/1993 | Martin | |
| 6,143,988 | A | 11/2000 | Neuroth et al. | |
| 6,179,056 | B1 | 1/2001 | Smith | |
| 7,789,131 | B2 | 9/2010 | Gaudette | |
| 2002/0070030 | A1 | 6/2002 | Smith et al. | |
| 2003/0170077 | A1 | 9/2003 | Herd et al. | |
| 2003/0196815 | A1* | 10/2003 | Crawford | E21B 17/203 166/369 |
| 2006/0124298 | A1* | 6/2006 | Geier | E21B 43/129 166/250.15 |
| 2009/0090503 | A1* | 4/2009 | Groves | E21B 43/003 166/249 |
| 2009/0145612 | A1 | 6/2009 | Olson et al. | |
| 2010/0230112 | A1* | 9/2010 | Cox | E21B 17/203 166/369 |
| 2011/0052417 | A1* | 3/2011 | Wells | E21B 43/129 417/53 |
| 2011/0280739 | A1* | 11/2011 | Lugtmeier | E21B 43/12 417/53 |
| 2014/0127065 | A1* | 5/2014 | Hansen | E21B 43/129 417/531 |

* cited by examiner

*Primary Examiner* — Shane Bomar
(74) *Attorney, Agent, or Firm* — Shawn Hunter

(57) ABSTRACT

Dual-walled coiled tubing assemblies are used to dispose a flow actuated pump into a wellbore. Dual-walled coiled tubing assemblies include an inner coiled tubing string and an outer coiled tubing string.

8 Claims, 3 Drawing Sheets

DUAL-WALLED COILED TUBING WITH DOWNHOLE FLOW ACTUATED PUMP

BACKGROUND OF THE INVENTION

1. Field of the Invention

The invention relates generally to the use of strings of coiled tubing to dispose flow actuated pumps into a wellbore and operation of such pumps.

2. Description of the Related Art

Downhole pumps are used to pump hydrocarbon fluids and/or water from subterranean locations. Electric submersible pumps ("ESPs") require electrical power to be supplied to them from surface. A typical ESP assembly includes a centrifugal pump that is mounted to an electrical motor. A power cable extends from the surface to the motor of the ESP assembly.

Flow actuated pumps are also known which utilize a piston or plunger to flow fluid, as opposed to a centrifugal pumping mechanism. A flow actuated pump is described in U.S. Pat. No. 7,789,131 entitled "Hydraulic Pump System for Deliquifying Low Rate Gas Wells." The '131 patent is owned by the assignee of the present invention and is hereby incorporated by reference in its entirety. The flow actuated pump described in the '131 patent uses a power fluid supplied from surface to operate the pumping mechanism rather than electrical power. Most flow actuated pumps return exhausted power fluid with the wellbore fluid (water, gas, etc.) being produced. However, some flow actuated pumps may have separate outputs for the exhausted power fluid and the wellbore fluid.

Dual-walled piping has been used in subsea applications to raise production fluid from a pump located on a seabed and not directly into a well. Such an arrangement is described in U.S. Patent Publication 2003/0170077 by Herd et al. However, dual-walled coiled tubing has not heretofore been successfully used in subterranean wellbores in conjunction with fluid driven or flow actuated pumps or for dewatering gas wells. The high pressure, high temperature conditions associated with a subterranean wellbore make the use of risers and flexible tubing impractical.

SUMMARY OF THE INVENTION

The invention provides systems and methods for disposing a flow actuated pump into a wellbore using running arrangements which incorporate a dual-walled coiled tubing running string having inner and outer coiled tubing strings. Fluid pumping arrangements are described in which the dual-walled coiled tubing running string supports the flow actuated pump and provides first and second fluid flow paths for fluid communication between the pump and the surface. An annulus is defined between the outer coiled tubing string and the wall of the wellbore. The annulus serves as a third fluid flow path for the fluid pumping arrangements.

According to a first described embodiment, a flow actuated pump is interconnected with the running string so that power fluid is provided to the pump via the first fluid flow path and the production fluid is returned via the second fluid flow path. Exhausted power fluid is returned via the third fluid flow path.

According to a second described embodiment, a flow actuated pump is interconnected with the running string so that power fluid is provided to the pump via the first fluid flow path and exhausted power fluid is returned via the second fluid flow path. Production fluid is returned via the third fluid flow path. In instances where the flow actuated pump is of the type which provides only a single output for intermingled water and power fluid, either or both of the second and third flow paths may be used to return the commingled fluid to the surface.

An embodiment is described wherein the flow actuated pump is zonally isolated such that fluid below a packer can be produced through the dual-walled coiled tubing running string.

BRIEF DESCRIPTION OF THE DRAWINGS

The advantages and further aspects of the invention will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE PREFERRED EMBODIMENTS

The term "dual-walled," as used herein, is intended to refer broadly to arrangements wherein an inner tubular string or member is located radially within an outer tubular string or member to provide a dual-walled tubing structure. A structure can be dual-walled without regard to whether the inner and outer tubular strings are coaxial or concentric.

Figure 1:
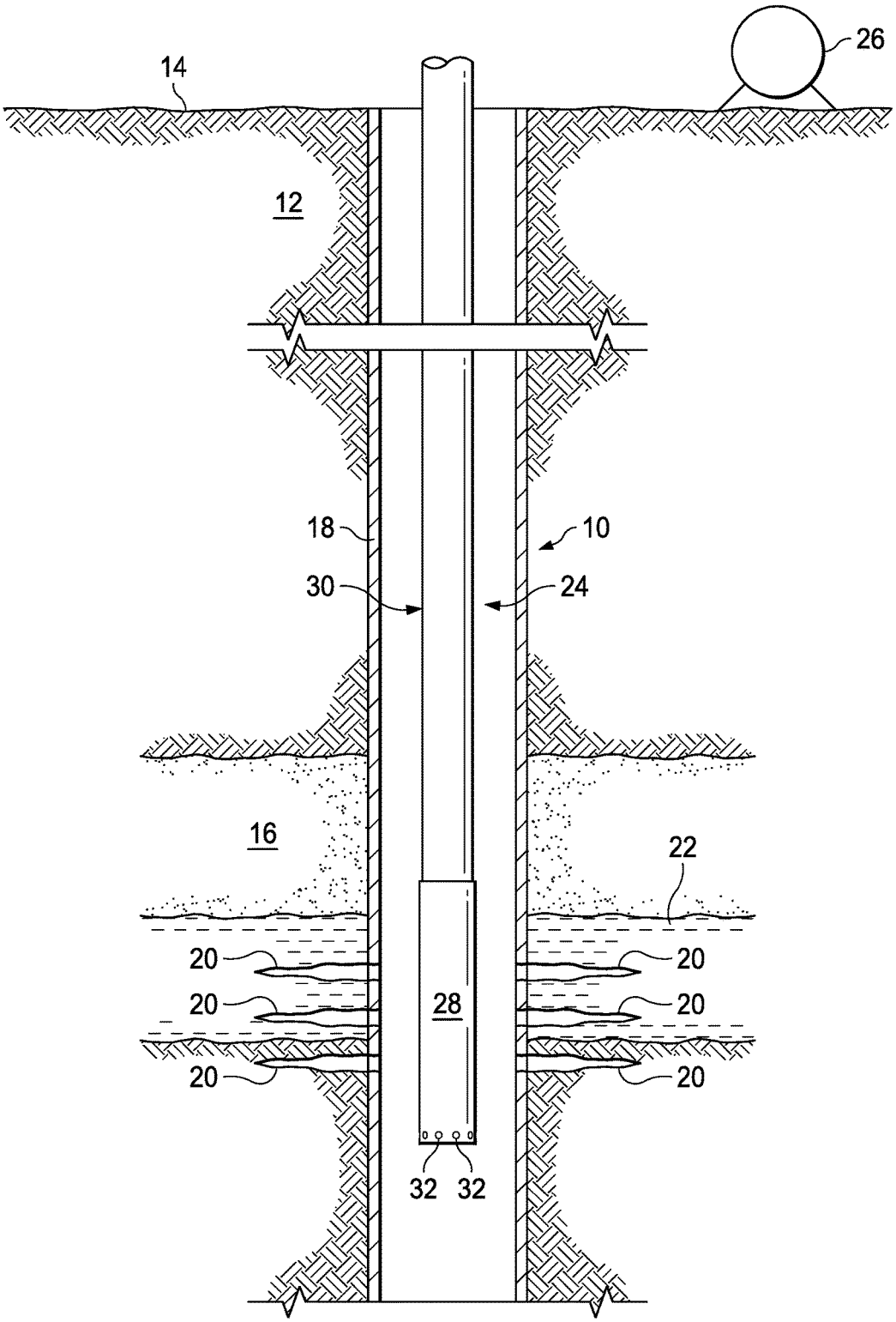
FIG. 1 is a side, cross-sectional view of an exemplary wellbore within which is disposed a fluid pumping assembly in accordance with the present invention.

FIG. 1 depicts an exemplary wellbore 10 that has been drilled through the earth 12 from the surface 14 down to a hydrocarbon-bearing formation 16. It is desired to pump fluids from the formation 16 to the surface 14. It is noted that, while wellbore 10 is illustrated as a substantially vertical wellbore, it might, in practice, have portions that are inclined or horizontally-oriented. The wellbore 10 is lined with metallic casing 18 in a manner known in the art. Perforations 20 pass through the casing 18 and into the formation 16. In the depicted embodiment, the formation 16 is a gas formation which contains water 22. It is desired to remove the water 22 from the formation 16.

In the arrangement shown in FIG. 1, a fluid pumping arrangement, generally indicated at 24, is disposed within the wellbore 10. The fluid pumping arrangement 20 is used to remove fluids from a subterranean location, such as formation 16. In the depicted embodiment, it is desired to pump the water 22 from the wellbore 10 to surface 14. A fluid pump 26 is located at the surface 14 and is operable to pump fluid down through the fluid pumping assembly 24.

The fluid pumping arrangement 24 includes a flow actuated pump 28 and a dual-walled coiled tubing running string 30. The flow actuated pump 28 is a non-electric fluid pump that is hydraulically-powered by a power fluid which is pumped by pump 26 from surface 14. The flow actuated pump 28 may be a pump of the type described in U.S. Pat. No. 7,789,131 entitled "Hydraulic Pump System for Deliquifying Low Rate Gas Wells." The '131 patent is owned by the assignee of the present application/patent and is hereby incorporated by reference in its entirety. The pump described in the '131 patent will return exhausted power fluid intermingled with the wellbore fluid being produced. As a result, it only requires a single flow path back to the surface 14. However, the flow actuated pump 28 might also be a pump which operates by returning the exhausted power fluid and the produced fluid separately. In that case, the pump 28 would require two separate flow paths back to the surface 14. In operation, water 22 is drawn into fluid inlets 32 of the flow actuated pump 28 and exits proximate the upper axial end of the pump 28 as will be described.

Figure 2:
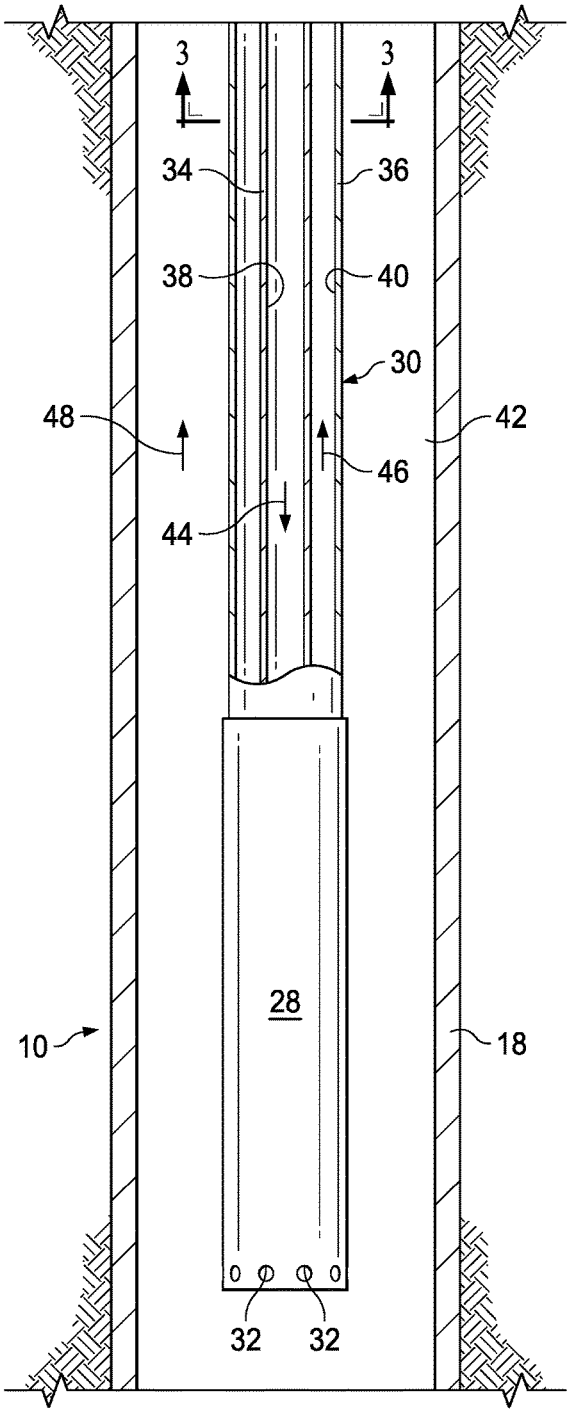
FIG. 2 is an enlarged cross-sectional view of the flow actuated pump portion of the fluid pumping assembly of FIG. 1 and associated components.
Figure 3:
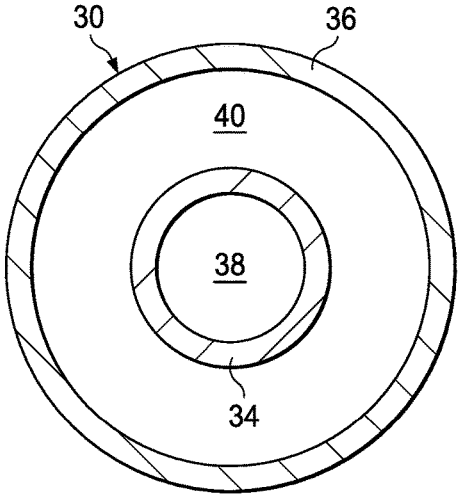
FIG. 3 is a cross-sectional view taken along lines 3-3 in FIG. 2.

Referring now to FIGS. 2 and 3, the dual-walled coiled tubing running string 30 includes an inner coiled tubing string 34 and an outer coiled tubing string 36 which radially surrounds the inner coiled tubing string 34. The inner coiled tubing string 34 defines a central axial fluid flow path along its length. A first fluid flow path 38 is in turn defined along this central axial fluid flow path. The outer coiled tubing string 36 defines an outer coiled tubing fluid flow path along its length, and a second fluid flow path 40 is defined radially between the inner and outer coiled tubing strings 34, 36. Exemplary sizes for the inner and outer coiled tubing strings 34, 36 are: 1.25" O.D.×0.125" wall thickness for the inner coiled tubing string 34 and 2.375" O.D.×0.156" wall thickness for the outer coiled tubing string 36. However, these dimensions are exemplary only, and other dimensions might be used. The inner and outer coiled tubing strings 34, 36 are normally connected together mechanically at surface and downhole ends and both would be hung off from the wellhead. Therefore, both strings 34, 36 may aid in supporting the weight of the flow actuated pump 28 as well as the inner and outer coiled tubing strings 34, 36. A third fluid flow path 42 is formed by the annulus between the outer coiled tubing string 36 and the casing 18. The presence of three separate fluid flow paths 38, 40 and 42 allows for a power fluid, used to actuate the flow actuated pump 28, to be flowed down to the flow actuated pump 28 and returned to surface 14.

FIG. 2 illustrates a first exemplary fluid pumping arrangement wherein a power fluid, used to actuate the flow actuated pump 28, is flowed down through the first fluid flow path 38, as indicated by arrow 44. Exhausted power fluid is flowed back to the surface 14 via the second fluid flow path 40 (arrow 46). Water 22 is flowed to surface 14 via the third fluid flow path 42, as indicated by arrow 48. In the instance wherein the flow actuated pump 28 is of the type which provides only a single output for intermingled water 22 and power fluid, either or both of the second and third flow paths 40, 42 may be used to return the commingled fluid to the surface 14.

According to a second exemplary fluid pumping arrangement, power fluid is flowed down through the first fluid flow path 38. Water 22 is flowed to surface 14 via the second fluid flow path 40. Exhausted power fluid is flowed back to the surface 14 via the third fluid flow path 42. Again, if the flow actuated pump 28 is of the type which provides only a single output for intermingled water 22 and power fluid, either or both of the second and third flow paths 40, 42 may be used to return the commingled fluid to the surface 14.

An assembled dual-walled coiled tubing assembly 30 can be wound onto a coiled tubing reel of a type known in the art for retaining spools of coiled tubing and transported to a well site for use. A flow actuated pump assembly, such as pump 28, is then affixed to the coiled tubing assembly 30 and run into the wellbore 10 in conventional fashion.

The dual-walled coiled tubing assembly 30 may be assembled by inserting the inner coiled tubing string 34 into the outer coiled tubing string 36. An assembled dual-walled coiled tubing assembly 30 can be wound onto a coiled tubing reel of a type known in the art for retaining spools of coiled tubing and transported to a well site for use. A flow actuated pump 28 is then affixed to the coiled tubing assembly 30 and run into the wellbore 10.

The invention provides methods of pumping fluid from a subterranean location in a wellbore. In accordance with these methods, a fluid pumping arrangement 24 is disposed into a wellbore 10 so that the pump 28 is located proximate the formation 16 from which it is desired to remove liquid (water 22). Power fluid is then pumped by pump 26 through the first fluid flow path 38 to the pump 28 to actuate the pump 28 to flow water 22 to surface 14 via either the second or third flow paths 40 or 42. Exhausted power fluid is returned to surface 14 via either the second or third flow paths 40 or 42.

Figure 4:
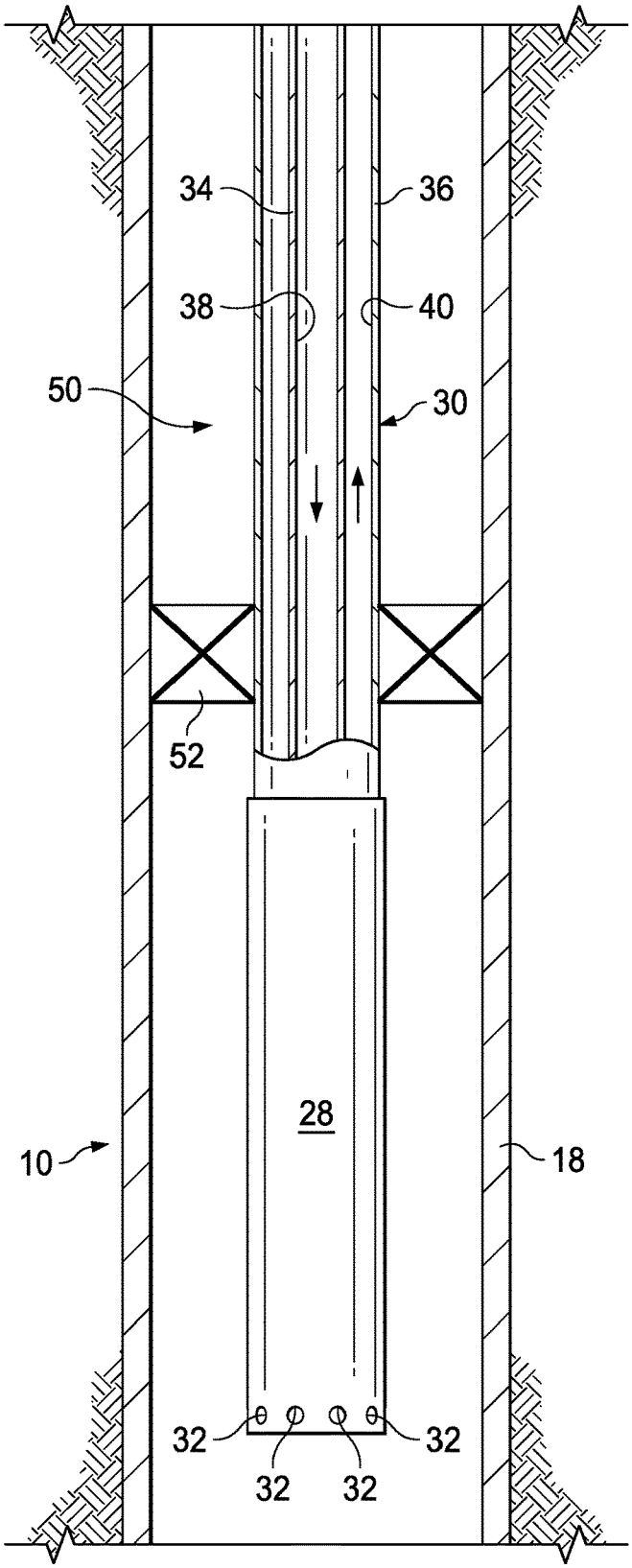
FIG. 4 is a side, cross-sectional view of a wellbore within which is disposed an alternative dual-walled coiled tubing running arrangement with flow actuated pump.

FIG. 4 illustrates an exemplary fluid pumping arrangement 50 which is being used for artificial lift of hydrocarbon production fluid from a wellbore 10. The fluid pumping arrangement 50 of FIG. 4 includes a packer 52 which is set against the casing 18 to isolate the flow actuated pump 28 below the packer 52. The flow actuated pump 28 of the fluid pumping arrangement 28 is carried by dual-walled coiled tubing running string assembly 30. The dual-walled coiled tubing assembly 30 includes an inner coiled tubing string 34 and an outer coiled tubing string 36. In this instance, the flow actuated pump 28 is of the type which provides a fluid output which is commingled exhausted power fluid and well fluid to be produced. A first fluid flow path 38 is defined radially within the inner coiled tubing string 34, and a second fluid flow path 40 is defined radially between the inner coiled tubing string 34 and the outer coiled tubing string 36.

It can be seen that the exemplary pumping arrangement 50 allows for zonal isolation within wellbores and permits fluids to be readily flowed past a packer 52 within a wellbore 10. The flow actuated pump 28 can be installed at a certain depth and one or more packers 52 are used to isolate well fluids above and below the flow actuated pump 28. Well fluids below the packer 52 can be lifted by the flow actuated pump 28 past the packer 52 via the second flow path 40.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention.

What is claimed is:

1. A fluid pumping arrangement for use in pumping a wellbore fluid from a subterranean location in a wellbore, the fluid pumping arrangement comprising:

a flow actuated pump;

a dual-walled coiled tubing running string for disposing the flow actuated pump into the wellbore, the dual-walled coiled tubing running string having:

an inner coiled tubing string defining an inner coiled tubing central axial pathway along its length;

an outer coiled tubing string radially surrounding the inner coiled tubing string;

a first fluid flow path is defined within the inner coiled tubing string;

a second fluid flow path is defined radially between the inner coiled tubing string and the outer coiled tubing string;

a third fluid flow path is defined radially between the outer coiled tubing string and a wall of the wellbore;

wherein power fluid for actuating the flow actuated pump is flowed to the flow actuated pump through the first fluid flow path; and wherein exhausted power fluid is flowed through the third fluid flow path and wellbore fluid is flowed through the second fluid flow path.

2. The fluid pumping arrangement of claim 1 wherein:

exhausted power fluid is flowed through the second fluid flow path; and the wellbore fluid is flowed through the third fluid flow path.

3. The fluid pumping arrangement of claim 1 wherein the wellbore fluid is water.

4. The fluid pumping arrangement of claim 1 further comprising a packer to zonally isolate the flow actuated pump within the wellbore.

5. A fluid pumping arrangement for dewatering a gas well, the fluid pumping arrangement comprising:

a flow actuated pump to pump water from the gas well;

a dual-walled coiled tubing running string for disposing the flow actuated pump into the wellbore, the dual-walled coiled tubing running string having:

an inner coiled tubing string defining an inner coiled tubing central axial pathway along its length;

an outer coiled tubing string radially surrounding the inner coiled tubing string, the outer coiled tubing string defining an outer coiled tubing string central axial passage along its length;

a first fluid flow path defined along the inner coiled tubing central axial pathway;

a second fluid flow path defined radially between the inner coiled tubing string and the outer coiled tubing string;

a third fluid flow path is defined radially between the outer coiled tubing string and a wall of the wellbore;

power fluid for actuating the flow actuated pump is flowed to the flow actuated pump through the first fluid flow path; and commingled exhausted power fluid and wellbore fluid are flowed through either or both of the second and third fluid flow path.

6. The fluid pumping arrangement of claim 5 wherein:

exhausted power fluid is flowed through the second fluid flow path; and the wellbore fluid is flowed through the third fluid flow path.

7. A method of pumping wellbore fluid from a subterranean location in a wellbore, the method comprising the steps of:

disposing a fluid pumping arrangement into the wellbore, the fluid pumping arrangement having a dual-walled coiled tubing running string and a flow actuated pump affixed to the dual-walled coiled tubing running string;

the dual-walled coiled tubing running string includes an inner coiled tubing string and an outer coiled tubing string;

flowing a power fluid through a first fluid flow path which is defined radially within the inner coiled tubing running string to actuate the flow actuated pump;

a second fluid flow path is defined radially between the inner coiled tubing string and the outer coiled tubing string; and wellbore fluid is flowed away from the flow actuated pump along the second fluid flow path.

8. The method of claim 7 wherein:

exhausted power fluid is flowed away from the flow actuated pump along the second fluid flow path.

* * * * *